US006500033B1

(12) United States Patent
Sagov

(10) Patent No.: US 6,500,033 B1
(45) Date of Patent: Dec. 31, 2002

(54) METHOD AND DEVICE FOR PROPULSION OF VESSELS

(75) Inventor: Magomet S. Sagov, Vestfossen (NO)

(73) Assignee: Clavis Biopropulsion AS, Hokksund (NO)

( * ) Notice: Subject to any disclaimer, the term of this patent is extended or adjusted under 35 U.S.C. 154(b) by 0 days.

(21) Appl. No.: 09/869,252

(22) PCT Filed: Dec. 29, 1999

(86) PCT No.: PCT/NO99/00406

§ 371 (c)(1),
(2), (4) Date: Jul. 21, 2001

(87) PCT Pub. No.: WO00/38979

PCT Pub. Date: Jul. 6, 2000

(30) Foreign Application Priority Data

Dec. 29, 1998 (NO) ..... 6181/98

(51) Int. Cl.[7] ..... B63H 1/30
(52) U.S. Cl. ..... 440/13; 440/17
(58) Field of Search ..... 440/13, 17–20

(56) References Cited

U.S. PATENT DOCUMENTS 829,681 A 8/1906 Tambling et al.
2,507,205 A * 5/1950 Griffin ..... 440/20

FOREIGN PATENT DOCUMENTS

| | | |
|---|---|---|
| FR | 2446220 | 8/1980 |
| FR | 2671778 | 7/1992 |
| WO | WO 95/16606 | 6/1995 |

* cited by examiner

*Primary Examiner*—Sherman Basinger
(74) *Attorney, Agent, or Firm*—Merchant & Gould, P.C.

(57) ABSTRACT

A method for propulsion of water-going vessels (1) comprising a plate (9), which is located in the water (2) and extends across a desired direction of motion for the vessel (1), where the plate (9) is moved from a first position (P1) to a second position (P2) and back. Under the influence of a motive force the extent of which varies sinusoidally, the plate (9) is brought into translatory and rectilinear oscillation about a neutral position (N2) between the first and the second position (P1 and P2 respectively), the neutral position (N2) being determined by a static equilibrium between spring forces influencing the plate (9). The plate (9) is controlled in such a manner that its plate plane extends perpendicularly to the vessel's (1) direction of motion, and a greater resistance is exerted by the plate (9) against the water when it is moved opposite to the vessel's desired direction of motion than when it is moved in this direction. A device for performing the method.

8 Claims, 1 Drawing Sheet

METHOD AND DEVICE FOR PROPULSION OF VESSELS

CROSS-REFERENCE TO RELATED APPLICATIONS

Statement Regarding Federally Sponsored Research or Development Reference to a "Microfiche Appendix"

BACKGROUND OF THE INVENTION

The invention relates to a method for propulsion of water-going vessels by means of a body which can be moved forward and backward relative to the vessels hull and which has a propulsion portion which is located in the water, a drive device which is arranged to move the body in a first direction, and a first resiliently elastic device or spring device which is arranged to exert spring forces against and move the body in a second, opposite direction, the propulsion portion's water resistance being greater when it is moved opposite a desired propulsion direction for the vessel than when it is moved in this propulsion direction.

The invention also relates to a device for performing the method.

In FR-A-2 446 220 there is disclosed a device of this type, However, there is no suggestion as to second spring means acting in the active direction of the propelling body such as to form an oscillating system with the propelling body and the first spring means in two directions about a neutral position and to provide for sinusoidal variation of the motive power.

In known types of mechanical propulsion of vessels where a body is moved in water which surrounds the vessel in order to provide a flow of water in a direction which is oppositely directed to the desired motion of the vessel, the body is rotated. Thereby relative movements of the water and the body are created and associated components of the force which are exerted by the water on the body, where some of these components do not contribute of the propulsion of the vessel. This is the case, e.g., in propeller propulsion as well as paddle wheel propulsion.

For propulsion of this kind where a mass of water m with a velocity v, e.g., is thrust backwards from a vessel per time unit, a reaction force $F=m \cdot v$ is obtained. Since the space available for a propeller behind a vessel is limited, and the propeller only partly utilises this space, a relatively high velocity v must be selected in order to achieve an acceptable thrust. This results in a substantial power loss as a result of propeller resistance, eddying, etc., in addition to possible cavitation.

BRIEF SUMMARY OF THE INVENTION

The object of the invention is to provide a method and a device of the type mentioned in the introduction, which is not encumbered by these disadvantages.

The characteristics of the method and the device are described briefly as follows.

A method for propulsion of water-going vessels by means of a body (8, 9, 10) which can be moved forward and backward relative to the vessel's hull in accordance with the principles of the claimed invention has a propulsion portion (9) which is located in the water (2), a drive device (4) which is arranged to move the body (8, 9, 10) in a first direction, and a first resiliently elastic device or spring device (11) which is arranged to exert spring forces against and move the body (8, 9, 10) in a second, opposite direction. The propulsion portion's (9) water resistance is greater when it is moved opposite a desired propulsion direction for the vessel than when it is moved in this propulsion direction.

The body (8, 9, 10) is influenced by further spring forces which are exerted in the first direction. The amount of motive power is varied sinusoidally. The spring force-influenced body (8, 9, 10) is brought into translatory and rectilinear oscillation with a natural frequency (E) in the two directions about a neutral position (N2), the neutral position (N2) being determined by a static equilibrium between the spring forces influencing the body (8, 9, 10).

A device for propulsion of water-going vessels by means of a body (8, 9, 10) which can be moved forward and backward relative to the vessel's hull in accordance with the principles of the claimed invention has a propulsion portion (9) which is located in the water (2), a drive device (4)which is arranged to move the body (8, 9, 10) in a first direction, and a first resiliently elastic device or spring device (11) which is arranged to move the body. (8,9,10) in a second, opposite direction. The propulsion portion's (9) water resistance being greater When it is moved opposite a desired propulsion direction for vessel than when it is moved in this propulsion direction.

The device comprises a second resiliently elastic device or spring device (12) which is arranged to move the body (8, 9, 10) in the first direction. The spring devices (11,12) and the body (8, 9, 10) forin-an-oscillating device with a natural frequency (E). The drive device (4) is arranged to provide the oscillating device with sufficient energy to bring the body (8, 9, 10) into oscillation with a natural frequency (E) and with a desired amplitude.

BRIEF DESCRIPTION OF THE SEVERAL VIEWS OF THE DRAWINGS

The invention will now be described in more detail with reference to the drawing which schematically illustrates an embodiment of a device according to the invention.

Figure 1:
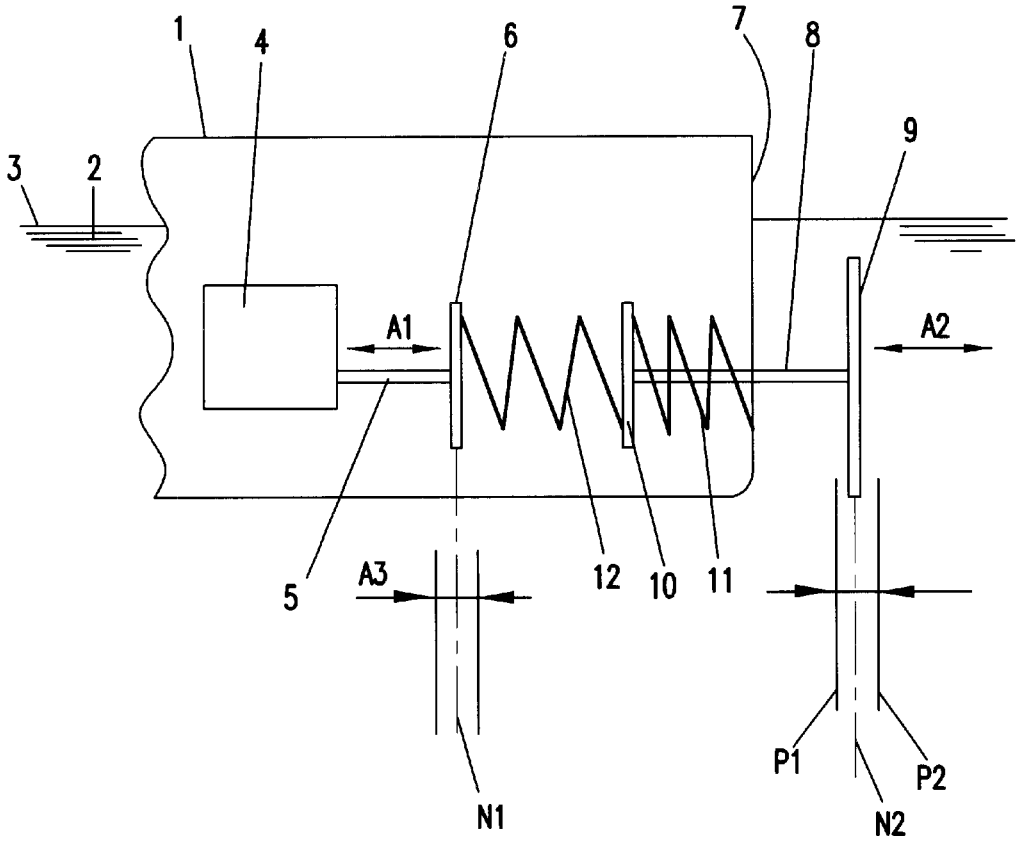
FIG. 1 is a side view of a vessel with a propellant device according to the invention, where portions of the vessel's hull have been cut away.

It should be understood that the vessel's bow faces the left-hand edge of the drawing and that this direction should be. designated as "forward".

DETAILED DESCRIPTION OF THE INVENTION

As is schematically illustrated in FIG. 1, a vessel 1 is floating in water 2 with a surface 3. The vessel has a motor 4 which has a driving rod 5, which can be moved forward and backward along the vessel's longitudinal direction, as indicated by the double arrow A1. The rear portion of the driving rod S is fixedly connected to a drive flange 6. A central or neutral position for the rear end of the drive flange 6 is indicated by N1 in the figure. Sealingly through the vessel's stenpost 7 there extends in the vessel's longitudinal direction a supporting rod 8, which is mounted in a bearing device (not shown), thus enabling the supporting rod 8 to be moved freely forward and backward linearly translatorily in this direction as indicated by the double arrow A2.

The rear end portion of the supporting rod 8 is fixedly connected to a plate-shaped water-influencing device, hereinafter called a plate 9, whose plate plane extends substantially perpendicularly to the supporting rod's longitudinal direction. The plate's height and width may correspond to the vessel's draught and width respectively. It will be understood, however, that the plate may project below the vessel's bottom 8 and be higher or lower than the vessel's draught, and be wider or narrower than the vessel's width. For forward propulsion of the vessel, the plate is formed in such a manner that it exerts a substantial. water resistance when it is moved backwards, but only a minimal water resistance when it is moved forwards. More precisely the plate can be designed in such a manner that water from the front side of the plate easily reaches the rear side of the plate when the plate is moved forwards, and that water from the rear side of the plate is substantially prevented from reaching the front side of the plate when the plate is moved backwards.

The supporting rod's front end portion is fixedly connected to a supporting rod flange 10 which extends across the supporting rod's longitudinal direction.

Between the vessel's sternpost 7 and the supporting rod flange 10 there is arranged a first compression spring device 11 which attempts to move the supporting rod 8 and thereby the plate 9 forwards. Similarly between the drive flange 6 and the supporting rod flange 10 there is arranged a second compression spring device 12 which attempts to move the supporting rod 8 and thereby the plate 9 backwards. In the drawing these spring devices 11, 12 are hereinafter called springs, symbolically illustrated as helical springs, although other suitable types of springs or spring devices may be employed. When the springs 11, 12 are at rest, i.e. in static equilibrium, and the drive flange 6 is located in its neutral position, the plate 9 is located in a central or neutral position as indicated by N2 in the figure.

During operation the motor 4 moves the driving rod S and the drive flange 6 in an oscillating manner, preferably sinusoidally time-dependently, about the first neutral position N1 as indicated by the arrows A3. The amplitude may be adjustable.

If the drive flange 6 is initially moved forward when the motor 4 is started, the second spring 12 is expanded. Thus this spring then exerts a reduced force against the supporting rod flange 10. The static equilibrium between the springs 11, 12 is thereby upset and the first spring 11 is also expanded, thus causing the supporting rod 8 and the plate 9 to be moved forward from the neutral position to a first position P1, downstream relative to the neutral position N2 and the vessel's forward direction.

When the drive flange 6 is then moved backwards, the second compression spring 12 is compressed to an increasing extent, exerting an increased force on the supporting rod flange 10. The first compression spring 11 is thereby compressed, with the result that the plate 9 is moved backwards, past the neutral position N2 to a second position P2, upstream relative to the neutral position N2.

The mass of the supporting rod 8, the plate 9 and the supporting rod flange 10 together with the springs 11, 12 form an oscillating device. An oscillation of this device is damped by, amongst other things, the water influence of the plate 9 and the device has a natural frequency E.

Figure 2:
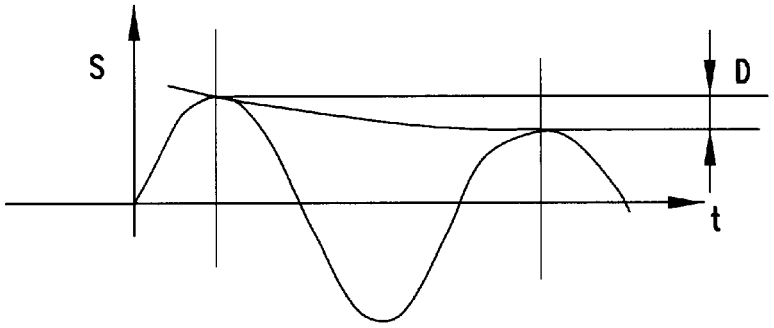
FIG. 2 is a graph illustrating a sinusoidal, time-dependent, damped movement of a plate.

FIG. 2 is a general illustration of a graph in which along a vertical axis is indicated the distance s from a neutral position for a freely oscillating object during two successive oscillations, and the time t is indicated along the other axis, the oscillatory motion being damped, i.e. the amplitude of the last oscillation has been reduced by a decrement D relative to the amplitude of the previous oscillation.

To prevent a reduction in the plate's amplitude during the course of an oscillation, for each oscillation the motor must provide the oscillating device with an output via the driving rod 5 according to the damped device's amplitude decrement.

For example, the oscillating device's frequency may be 50 Hz, but this frequency naturally depends on the device's size, design and other operating conditions.

By means of this propulsion device an enormous mass of water can be moved. Thus, in order to achieve the desired motive power for the vessel, the water moved can have a low velocity. Furthermore, a very low level of noise is emitted by the device during operation. The total efficiency of the vessel's propulsion device can thereby be substantial.

The danger which a rotating propeller represents for objects in the water is avoided with the device according to the invention.

It will be appreciated that the plate can generate a movement of the vessel in a desired direction, depending on the plate's direction of motion and that the term propulsion should be understood as a movement of the vessel in this direction. Moreover, it will be understood that more than one plate may be employed.

What is claimed is:

1. A method for propulsion of water-going vessels, comprising the steps of:

arranging a body that is movable forward and backward relative to a hull of the vessel, the body comprising propulsion portion located in water, a rod extending in a longitudinal direction of the vessel and sealingly through a sternpost of the vessel, a rear end portion of the rod being fixedly connected to the propulsion portion and, a flange extending transversely relative to the rod, and fixedly connected to a front end portion of the rod, arranging a drive device so as to move the body in a first direction, the drive device comprising a drive element, arranging a first resiliently elastic device comprising a first spring between the flange and a fixed portion of the hull so as to exert spring forces against and move the body in a second direction opposite the first direction direction, a water resistance of the propulsion portion being greater when the propulsion portion is moved opposite a desired propulsion direction for the vessel than when the propulsion portion is moved in the desired propulsion direction, arranging a second resiliently elastic device comprising a second spring on an opposite side of the flange from the first resiliently elastic device, between the flange and the drive exerting further spring forces on the body in the first direction, and varying an amount of motive power sinusoidally, so as to bring the body into translatory and rectilinear oscillation with a natural frequency (E) in the first and second directions about a neutral position, the neutral position being determined by a static equilibrium between the spring forces influencing the body.

2. A method according to claim 1, further comprising the step of providing the body with sufficient energy via the drive device to compensate for an amplitude decrement for the body.

3. A method according to claim 1, further comprising the step of adapting the spring forces to a mass of the body, such that the natural frequency is approximately 50 Hz.

4. A method according to claim 1, further comprising the step of providing the body with energy impulses with a frequency corresponding to the natural frequency.

5. A device for propulsion of water-going vessels, comprising a body that is movable forward and backward relative to a hull of the vessel, the body comprising a propulsion portion located in the water, a rod extending in a longitudinal direction of the vessel and sealingly through a sternpost of the vessel, a rear end portion of the rod being fixedly connected to the propulsion portion and, a flange extending transversely relative to the rod, and fixedly connected to a front end portion of the rod, a drive device adapted to move the body in a first direction, the drive device comprising a drive element, a first resiliently elastic device comprising a first spring disposed between the flange and a fixed portion of the hull so as to move the body (8, 9, 10) in a second direction opposite the first direction, a water resistance of the propulsion portion being greater when the propulsion portion is moved opposite a desired propulsion direction for the vessel than when the propulsion portion is moved in the desired propulsion direction, a second resiliently elastic device comprising a second spring disposed on an opposite side of the flange from the first resiliently elastic device, between the flange and the drive element, arranged to move the body in the first direction, wherein the first and second spring elastic devices and the body form an oscillating device with a natural frequency, and wherein the drive device is arranged to provide the oscillating device with sufficient energy to bring the body into oscillation with the natural frequency and with a desired amplitude.

6. A device according to claim 5, wherein the drive device is adapted to provide the body with sufficient energy to compensate for an amplitude decrement of the body.

7. A device according to claim 6, wherein the drive device is adapted to provide the body with energy impulses with a frequency corresponding to the natural frequency.

8. A device according to claim 5, wherein the natural frequency is approximately 50 Hz.

* * * * *